United States Patent [19]

Uke

[11] Patent Number: 4,985,812

[45] **Date of Patent: * Jan. 15, 1991**

[54] WATERPROOF FLASHLIGHT WITH FINGER SWITCH

[76] Inventor: Alan K. Uke, 5980 Rancho Diegueno, Rancho Santa Fe, Calif. 92067

[ * ] Notice: The portion of the term of this patent subsequent to Sep. 26, 2006 has been disclaimed.

[21] Appl. No.: 382,428

[22] Filed: Jul. 20, 1989

Related U.S. Application Data

[63] Continuation-in-part of Ser. No. 149,533, Jan. 28, 1988, Pat. No. 4,870,550.

[51] Int. Cl.[5] ..... F21L 7/00

[52] U.S. Cl. ..... 362/158; 362/187; 362/202; 362/205

[58] Field of Search ..... 362/157, 158, 187, 188, 362/200, 202, 204, 205, 208, 267; 60/200

[56] References Cited

U.S. PATENT DOCUMENTS

| | | | |
|---|---|---|---|
| 3,398,271 | 8/1968 | Sakamoto | 362/158 |
| 4,527,223 | 7/1985 | Maglica | 362/158 |
| 4,531,178 | 7/1985 | Uke | 362/158 |
| 4,774,644 | 9/1988 | Ohashi | 362/202 |
| 4,803,605 | 2/1989 | Schaller et al. | 362/205 |
| 4,823,242 | 4/1989 | Maglica et al. | 362/187 |
| 4,870,550 | 9/1989 | Uke | 362/158 |

FOREIGN PATENT DOCUMENTS

| | | | |
|---|---|---|---|
| 1168408 | 8/1969 | United Kingdom | 362/205 |

*Primary Examiner*—Stephen F. Husar
*Assistant Examiner*—D. M. Cox
*Attorney, Agent, or Firm*—Brown, Martin, Haller & McClain

[57] ABSTRACT

A compact battery-powered flashlight adapted for underwater use which includes a casing, an illumination unit, a sealant device, a connection device and a switch element. The casing is hollow and substantially oval in cross-section while having a closed rear end and a head receiving forward end. The head receiving forward end of the casing has a hollow outwardly protruding cylindrical neck. The casing further is adapted to receive at least two parallel adjacent rows of batteries with at least one battery per row. The casing neck is axially aligned with one of the rows of received batteries. The illumination unit is mounted upon the neck and generates light upon electrical connection to the batteries. The sealant device is disposed between the illumination unit and the neck for providing a watertight seal therebetween. The connection device is used to electrically connect the illumination device to the batteries received within the casing. The switch element is used to selectively interrupt the electrical connection provided by the connection device between the illumination device and the batteries.

17 Claims, 1 Drawing Sheet

WATERPROOF FLASHLIGHT WITH FINGER SWITCH

BACKGROUND OF THE INVENTION

I. Field of the Invention

This application is a continuation-in-part application of Ser. No. 07/149,533 filed Jan. 28, 1988, entitled "WATERPROOF FLASHLIGHT" now U.S. Pat. No. 4,870,550 issued Sept. 26, 1989. The present invention relates to underwater flashlights. More specifically, the present invention relates to a novel and improved compact, battery-powered diver's flashlight adapted for underwater use and configured for ease in handling and storage.

II. Background Art

The usual reduced visibility encountered underwater requires a source of light if a diver is to perform useful work. Because of the breathing equipment worn and protective clothing often required by a diver, his mobility and manual dexterity are severely reduced. These factors necessitate that the light source be rugged, easily held and simple to use. Finally, the electrical conductivity and pressure of the diver's water environment require exceptional watertight integrity to permit reliable operation of a light source underwater. An underwater flashlight is capable of providing the necessary illumination under most circumstances provided that it is rugged and easy to carry, versatile in producing an appropriate beam pattern, and has secure watertight integrity including the switching arrangement. Since diving operations are often conducted at remote sites, far from sources of supply, it is desirable that a flashlight for divers be easy to repair and rechargeable from a generally available electrical power source.

Constructions for divers' flashlights have been provided using waterproof covers with control switches operated through seals. However, such seals wear and leak after a period of use. Parts removable from the flashlight, and openings in the flashlight such as battery charging connections must be sealed. The latter requirement poses problems servicing a diver's flashlight since the seals are often damaged or destroyed in use and are difficult to remake.

Applicant of the present invention has solved many of the shortcomings of prior art devices by the development of a device disclosed in his U.S. Pat. No. 4,531,178 entitled "DIVER'S FLASHLIGHT" issued July 23, 1985, the disclosure of which is incorporated by reference herein. Applicant's invention previously patented provides the operational features and characteristics desired in an underwater flashlight while at the same time eliminating or minimizing the noted hazards in providing a diver's flashlight capable of continued effective use and easy servicing. The present invention provides an improvement of Applicant's previously patented invention by providing a diver's flashlight with features of ease in handling, carrying, and storage.

Applicant's previously patented flashlight furthermore is turned on and off by rotating the flashlight illumination head which is mounted at one end of the flashlight body. It is recognized that this type of flashlight may at times be inadvertently turned on. For example, handling or movement of baggage in which the flashlight is stored may cause inadvertent rotation of the flashlight illumination head on the body. As a result, the flashlight may be turned on and the batteries drained before one discovers that the flashlight was left on.

The present invention provides a further improvement in such a diver's flashlight by providing an on/off override switch, located in a position convenient for use, for controlling flashlight operation.

It is, therefore, an object of the present invention to provide a novel and improved configuration for a diver's flashlight which incorporates.

SUMMARY OF THE INVENTION

The waterproof flashlight described herein provides a strong focusable light beam while overcoming the problems of prior devices. It includes an elongated hollow casing of substantially oval cross-section having one end closed and the other end partially open. A hollow, outwardly protruding cylindrical neck is formed at the other end and provides an opening into the interior of the casing. First and second adjacent parallel rows of batteries are positioned within the casing with each row of batteries being in axial alignment in a longitudinal end to end arrangement. Opposite polarity terminals contact between the batteries in each row. The first row of batteries are axially aligned with the neck.

A dual contacting spring is positioned along the rear or closed end wall of the casing and electrically connects one polarity terminal of a battery in the second row of batteries with an opposite polarity terminal of a battery in the first row. The spring urges the batteries toward the neck end. A connector strip is positioned longitudinally along an inner side wall of the neck and includes a first contact portion adjacent the opening of the neck. The connector strip includes at an opposite end a pair of spring biased legs in a U-shaped configuration. A rotary switch element is mounted in the casing beneath the neck. The switch element includes a switch contact which contacts the opposite polarity terminal of the other battery in the second row of batteries. Rotation of the switch to a first position places the switch contact in electrical contact with the legs. Rotation of the switch to a second position displaces the switch contact from electrically contacting the legs.

A cylindrical barrel having a light window at one end is in threaded watertight engagement with the open end of the neck. The barrel houses a reflector block which is urged by the spring against the window. The reflector block includes a halogen bulb and a faceted reflecting surface. A resilient washer spaced between the reflector block and a conduction cap which surrounds the bulb. The bulb is energized when the barrel is threaded into an on position on the neck. In the on position, the bulb circuit is completed with the batteries coupled to the bulb through the second connector strip which contact the conduction cap with the other battery in the first row contacting the bulb. The barrel action thus performs as the flashlight switch as well as sealing the open end of the casing. The washer and conduction cap permit adjustment of the bulb position with respect to the reflector to focus the beam in conjunction with the barrel's sealing and switching function.

BRIEF DESCRIPTION OF THE DRAWINGS

The just described features, objects, and advantages of the present invention, along with others, will be more fully apparent from the detailed description set forth below taken in conjunction with the drawings in which like reference characters identify correspondingly throughout and wherein.

DETAILED DESCRIPTION OF THE PREFERRED EMBODIMENTS

Figure 1:
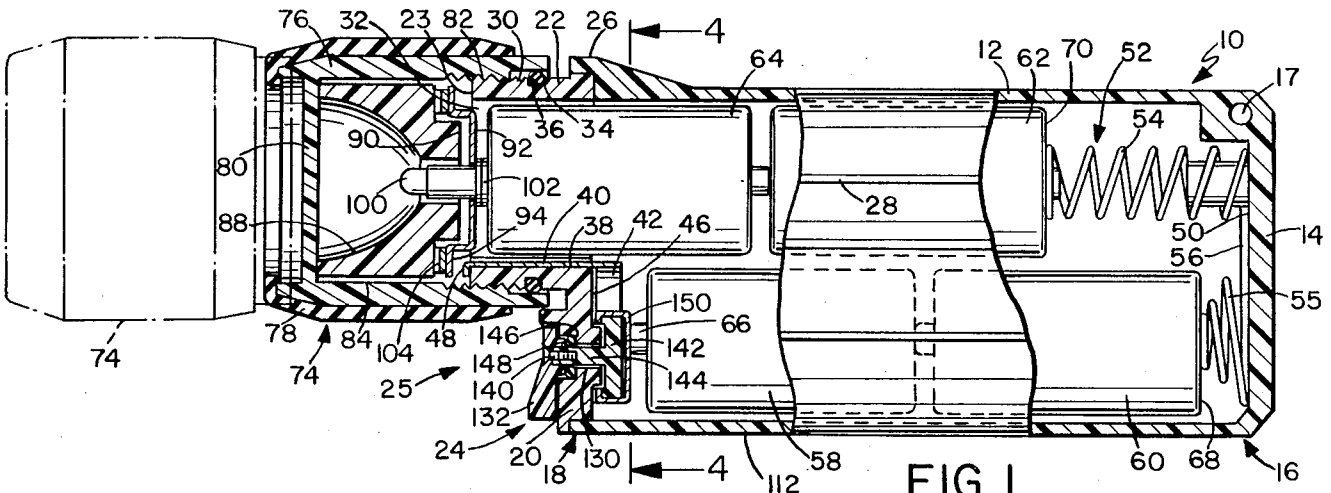
FIG. 1 is a side elevation view, partially cut away, illustrating the improved waterproof flashlight of the present invention.

Referring to FIG. 1 of the drawings, flashlight 10 includes an elongated hollow casing 12 of substantially oval cross-section. Casing 12 includes a rear case wall 14 formed at a rear end 16 of casing 12 which closes end 16. Hole 17 is formed in rear case wall 16 to permit a lanyard to be attached to case 12. Hole 17 extends through rear case wall only and does not extend into the hollow interior of casing 12. The other end of casing 12, end 18, is open.

A front case wall 20 is mounted at case 12 at open end 18. Front case wall 20 has a hollow outwardly protruding cylindrical neck 22 formed at an upper portion 23 thereof and a two position rotary switch 24 mounted at a contoured lower portion 25 thereof.

Casing 12 is preferably manufactured from a tough plastic material such as Lexan and may be transparent, translucent or opaque. Flange 26 is formed near open end 18 of casing 12 adjacent where neck 2.2 is positioned. Casing 12 may include longitudinal ribs 28 to provide a good gripping surface for the diver to hold flashlight 10. When held, the user typically places their hand around the casing with a finger positioned below neck 22 upon front case wall 20 at lower portion 25.

Figure 2:
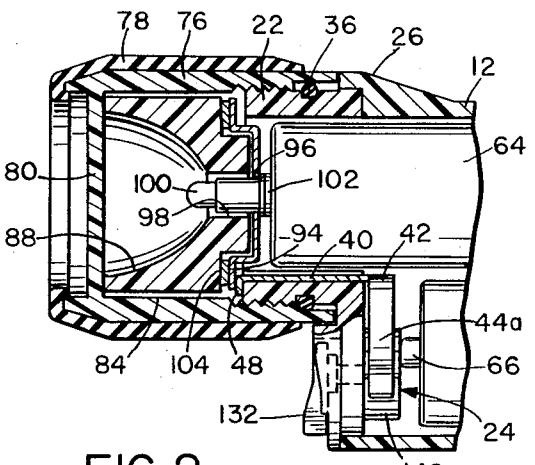
FIG. 2 is a portion of FIG. 1 cut away illustrating the flashlight head seated on the casing neck, with a portion cut away, in the on position.

Referring to FIGS. 1 and 2, external screw threads 30 are formed adjacent open end 32 of neck 22, opposite the coupling of wall 20 to end 18. An annular groove 34 is formed in neck 22 adjacent threads 30. Groove 34 seats a resilient sealing ring or 0-ring 36.

Neck 22 includes an elongated internal groove 38 extending from open end 32 to the interior of case 12. A connector strip 40 of an electrically conductive material is disposed within groove 38. At one end of connector strip 40 is an integrally formed and substantially U-shaped contact portion 42. Contact portion 42 defines a pair of spaced apart spring biased legs **44*a* and 44*b* (FIG. 4) which extend at an angle substantially perpendicular to strip 40. Legs 44*a* and 44*b* extend downwardly from strip 40 within the interior of case 12 adjacent an inner face 46 of wall 20. Strip 40 has formed at an end opposite contact portion 42 contact portion 48 which is formed by folding over the end of strip 40 at the end 32 of neck 22**.

Wall 20 at lower portion 25 is contoured to provide a finger gripping surface. Hole 130 extends through wall 20 from wall outer face 47 to wall inner face 46 (FIG. 1). Switch 24 is mounted on wall 20 at hole 130. Switch 24 includes a contoured actuating arm 130 located against outer face 47.

Figure 3:
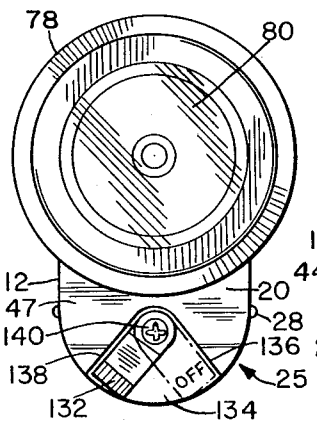
FIG. 3 is a front end view of the flashlight of FIG. 1.

Referring to FIG. 3, outer face 47 includes a recessed area 134 (FIG. 3) which forms stops 136 and 138. Arm 132 rotates between stops 136 and 138. When arm 132 is positioned against stop 136 the switch is in the "on" position. Similarly when arm 132 is positioned against stop 138 it is in the "off" position.

Referring to FIGS. 1 and 2 again, arm 132 is coupled at one end by screw 140 to an insulating hub 142. Hub 142 is positioned adjacent inner face 46 and includes an integrally formed center shaft 144 which extends outwardly from inner face 46 through hole 130 for engagement with arm 132. Screw 140 secures arm 132 to hub 142 at center shaft 144. An annular groove 146 is formed in outer face 47 about hole 130 into which 0-ring 148 is placed. The use of 0-ring 148 ensures sealing of the flashlight at switch 24. A light layer of silicone grease may be used on 0-ring 148 and the adjacent areas to enhance watertight sealing at switch 24. Though a rotary-type switch is illustrated herein, it is envisioned that other types of switches well known in the art may be used.

Figure 4:
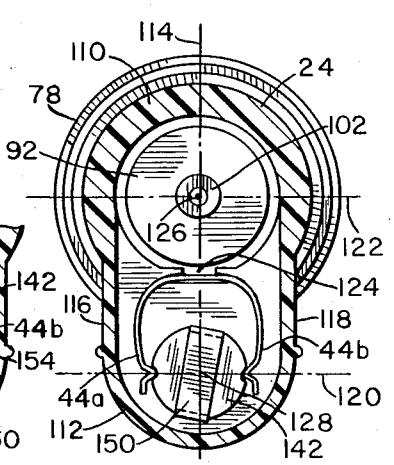
FIG. 4 is a sectional view taken along line 4—4 of FIG. 1 illustrating the switch in the off position.
Figure 5:
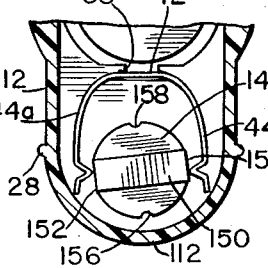
FIG. 5 is a view similar to a portion of FIG. 4 illustrating the switch in the on position.

Referring to FIGS. 4 and 5, hub 142 includes a diametrical connecting strip 150 positioned on a face of hub 142. Connecting strip 150 is folded over the side of hub 142 to form contacts 152 and 154. Hub 142 also includes axial grooves 156 and 158 formed diametrically opposed from one another in the side of hub 142. Grooves 156 and 158 are radially positioned approximately 90 from contacts 152 and 154.

In FIG. 4, legs **44*a* and 44*b* respectively engage grooves 156 and 158 In the illustrated position switch 24 is in the "off" position (FIG. 3). Grooves 156 and 158 engage legs 44*a* and 44*b* and assist in retaining switch 24 in the "off" position. In FIG. 5, legs 44*a* and 44*b* engage contacts 152 and 154 and complete an electrical circuit as described later herein. In FIG. 5, switch 24** is illustrated in the "on" position.

Positioned at an inner face 50 of wall 14 is a unitary dual contacting spring 52. Spring 52 includes a first spring portion 54 which is positioned in an upper portion of the interior of casing 12 adjacent wall 14 and alignably facing neck opening 32. Spring 52 includes a second spring portion 55 which is positioned in a lower portion of the interior of casing 12 adjacent wall 14 and alignably facing switch 24. A connecting bar portion 56 connects spring portions 52 and 54.

As illustrated in FIG. 1, batteries 58, 60, 62 and 64 are mounted within casing 12. Batteries 58, 60, 62 and 64 are typically rechargeable batteries. Batteries 58 and 60 are axially positioned in axial alignment in an end to end relationship in a lower portion of casing 12. The outer end terminals 66 and 68 of batteries 58 and 60 respectively contact connecting strip 150 and second spring portion 55 of spring 52. Batteries 62 and 64 are positioned in axial alignment in end to end relationship in an upper portion of casing 12. Batteries 62 and 64 are also in axial alignment with neck 22. The outer end terminal 70 of battery 64 contacts spring portion 56. In essence, batteries 58 and 60 form a lower row while batteries 62 and 64 form an upper row, with both rows parallel with respect to each other. Individual batteries are inserted into casing 12 through the open end 32 of neck 22.

The flashlight head 74 is illustrated in FIG. 1 in dashed lines as being separated from casing 12. Head 74 incorporates lamp focusing and alignment features. Head 74 includes a cylindrical flashlight barrel 76 and an outer rubber housing 78. Lamp reflector block 86 positioned within barrel 76. In FIGS. 1 and 2, barrel 76 is depicted as being threaded upon the neck 22. It is preferred that 0-ring 36 and the adjacent areas of neck 22 and barrel 76 be lightly lubricated with a silicone grease to enhance sealing.

Barrel 74 has a transparent end window 80 at one end, internal threads 82 adjacent an open opposite, and a smooth internal bore portion 84 there between. A cylindrical reflector block 86 is housed within barrel 74 and has a substantially parabolic reflector cavity surface 88 formed therein. Facets formed on surface 88 serve to form an even beam with less parabolic curvature. Reflector block 88 is formed with an annular shoulder portion 90 at the end opposite the reflector.

A conducting cap 92 fits slideably over the shoulder portion 90 and has a rim 94 for providing an electrical contact surface for cap 92. The shoulder portion 90 of block 80 and cap 92 have in-line cylindrical apertures 96 and 98 respectively. A socket-type halogen bulb 100 is mounted in the cap aperture 98 with a friction fit. The bulb 100 extends through the aperture 96 into the reflector cavity towards the head focal point.

Terminal 102 of bulb 100 is axially aligned with battery 64 and contacts terminal 72 thereof. An annular resilient wave washer 104 is interposed between the cap rim 94 and the reflector block 74. The compressible undulations of the washer 104 provide spring action tending to hold cap 92 away from reflector block 80. The spring action, in conjunction with the slideably fit of cap 92 on block 80, provides for a longitudinal movement of the bulb toward and away from the focal of reflector cavity 88.

To operate flashlight 10 illustrated in FIGS. 1 and 2, barrel 76 is threaded upon neck 22. In FIG. 2, bulb 100 is energized by the battery electrical potential being applied to bulb 100 when contact portion 48 is urged into contact with conductive cap rim 94 by barrel 76 being threaded upon the neck 12. When the latter contact is first made, bulb 100 is energized, but the filament is not positioned at the focal point of the reflector. As a result, a diffused light beam is formed by the flashlight.

Further threading or rotation of the barrel 76 upon the neck 22 engages casing flange 26. This engagement compresses resilient washer 104 and positions the lamp filament at the focal point of the reflector so as to produce a parallel uniform flashlight beam. Therefore, the barrel action performs a beam focusing function as well as a switching and sealing function.

Switch 24 is essentially a master on/off switch or power interrupt switch. Switch 24 is particularly useful when flashlight 10 is stored. Switch 24 provides an additional interruption in battery power to bulb 100. In the event of inadvertent twisting of barrel 76 normally sufficient to turn on flashlight 10, switch 24 maintains interruption of the battery/bulb electrical circuit. This feature is particularly useful in instances where flashlight 10 is stored, such as in a bag, where moving of the bag by an individual causes the twisting of barrel 76 normally sufficient to turn on flashlight 10. Absent the individual noticing that the stored flashlight is on, the batteries would be discharged. Once discharged, the batteries would have to be recharged, if of the rechargeable type, or replaced if not of the rechargeable type.

Switch 24 also serves as a master power switch. For example, when a desired illumination pattern is achieved by rotation of barrel 76, flashlight 10 may be turned off using switch 24. The particular illumination pattern may then be saved for other times by interrupting power to flashlight 10 by switch 24. The area beneath neck 22 is typically where the user positions a gripping finger. Thus, the location of switch 24 beneath neck 22 provides easy access by the user in turning flashlight on and off.

FIG. 4 illustrates a rear view of flashlight 10. In FIG. 4, the cross-section of case 12 has curved upper and lower portions 110 and 112 centered on a vertical major axis 114 and parallel side wall portions 116 and 118 interconnect upper and lower portion 110 and 112. A pair of minor axis 120 and 122 are perpendicular to major axis 114 and are equidistantly spaced from casing center point 124 on major axis 114. Axis 120 and 122 respectively intersect with axis 114 at points 126 and 128. The row of batteries 58 and 60 are axially aligned with a longitudinal axis that extends perpendicular to axis 114 and 120 and through point 128. The row of batteries 62 and 64 are axially aligned with a longitudinal axis that extends perpendicular to axis 114 and 122 through point 128. The axis running through points 128 and 126 are perpendicular to one another. The axis extending through point 128 is a central axis to neck 12.

The previous description of the preferred embodiments are provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiments shown herein, but is to be accorded the widest scope consistent with the principles and novel features disclosed herein.

I claim:

1. A flashlight for receiving batteries therein and adapted for underwater use, comprising:

a hollow casing being substantially oval in cross-section and having a closed rear end and a head receiving forward end, said head receiving end having first and second portions, said first portion having a hollow outwardly protruding cylindrical neck formed thereat and said second portion having an end wall formed thereat, said casing for receiving at least two parallel adjacent rows of batteries with at least one battery positioned in each row, and said neck substantially axially aligned with one of said battery rows and said end wall facing at least another one of said battery rows;

illumination means mounted upon said neck for, receiving electrical power from said batteries and generating light;

sealant means disposed between said illumination means and said neck for providing a watertight seal between said illumination means and said neck;

connection means for electrically connecting said illumination means to said batteries; and switch means coupled to said connection means for selectively interrupting said electrical connection when said connection means electrically connects said illumination means to said batteries.

2. The flashlight of claim wherein said illumination means comprises:

a hollow, substantially cylindrical barrel having a transparent window at one end and open at the other end;

a light bulb;

reflector means, positioned within said barrel, for receiving said light bulb and for reflecting light generated by said light bulb through said window; and wherein said barrel is mounted at said barrel open end upon said neck.

3. The flashlight of claim 2 wherein said barrel includes internal threads formed adjacent said barrel open end and said neck has externally formed mating threads for making with said barrel threads.

4. The flashlight of claim 2 wherein said reflector means comprises a cylindrical reflector block having a parabolic reflecting surface facing said window, said reflecting surfacing having a plurality of facets formed therein.

5. The flashlight of claim 1 wherein said sealant means comprises an 0-ring positioned on said neck.

6. The flashlight of claim 1 wherein said connection means comprises:

manually operable means for telescopically moving said illumination means along a longitudinal axis of said neck;

contact means responsive to the position of said illumination means upon said neck for selectively electrically coupling said illumination means to batteries received within said casing.

7. The flashlight of claim 1 wherein said switch means comprises:

a rotary switch element rotably mounted in said end wall at said second portion, said switch element having an actuating arm positioned at a casing exterior side of said end wall, an insulated hub positioned adjacent a casing interior side of said end wall with said hub having an integrally formed shaft extending through said end wall and coupled to said arm and with said hub having a contact member mounted thereupon adapted for electrically contacting a battery; and switch contact means electrically coupled to said connection means and responsive to a position of said contact member for electrically coupling said batteries to said connection means.

8. The flashlight of claim 6 wherein said switch means comprises:

a rotary switch element rotatably mounted in said end wall at said second portion, said switch element having an actuating arm positioned at a casing exterior side of said end wall, an insulated hub positioned adjacent a casing interior side of said end wall with said hub having an integrally formed stem extending through said end wall and coupled to said arm and with said hub having a contact member mounted thereupon adapted for electrically contacting a battery; and switch contact means electrically coupled to said contact means and responsive to a position of said contact member for electrically coupling said batteries to said contact means.

9. The flashlight of claim 1 wherein said casing further comprises:

an elongated continuous side wall, substantially oval in cross-section and defining a hollow interior, said side wall having an open forward end and a closed rear end, said rear end closed by a rear end wall formed with said side wall; and a forward end wall mounted at side side wall open forward end, said forward end wall defining first and second forward end wall portions with said first forward end wall portion having a hollow outwardly protruding cylindrical neck formed thereat and said second forward end wall portion enclosing said case interior and having an outer gripping surface.

10. A compact, battery-powered underwater flashlight comprising:

an elongated hollow casing substantially oval in cross-section and having a side wall and a closed rear end and a partially closed head receiving forward end, said head receiving end having an upper portion with a hollow outwardly protruding cylindrical neck with an outer open end and a lower portion with an end wall substantially perpendicular to said side wall and having an outer gripping surface, said casing for receiving two parallel adjacent rows of at least one battery per row, and said neck substantially axially aligned with one of said batteries rows;

a hollow, substantially cylindrical barrel having a transparent window at one end and having an open other end;

a cylindrical reflector positioned within said barrel having a substantially parabolic reflective surface facing said window and a central axial throughbore;

a light bulb positioned in said reflector throughbore;

coupling means for movably coupling, along a common longitudinal axis, said barrel adjacent said barrel open end upon said neck adjacent said neck outer open end in a telescopic arrangement;

sealant means positioned between said barrel and said neck for providing a watertight seal therebetween;

connection means responsive to the relative positioning of said barrel upon said neck for electrically connecting and disconnecting said light bulb with batteries received within said casing; and switch means mounted at said end wall lower portion and electrically disposed between said connection means and batteries received within said casing for selectively interrupting said electrical connection when said connection means electrically connects said illumination means to said batteries.

11. The flashlight of claim 10 wherein said connection means comprises:

manually operable means for telescopically moving said illumination means along a longitudinal axis of said neck;

contact means responsive to the position of said illumination means upon said neck for selectively electrically coupling said illumination means to batteries received within said casing.

12. The flashlight of claim 11 wherein said switch means comprises:

a rotary switch element rotatably mounted in said end wall at said second portion, said switch element having an actuating arm positioned at a casing exterior side of said end wall, an insulated hub positioned adjacent a casing interior side of said end wall with said hub having an integrally formed stem extending through said end wall and coupled to said arm, said hub further having a contact member mounted thereupon adapted for electrically contacts a battery, and an 0-ring disposed in said end wall at said casing exterior side about said hub; and switch contact means electrically coupled to said contact means and responsive to a position of said contact member for electrically coupling said batteries to said contact means.

13. The flashlight of claim 10 wherein said coupling means comprises internal threads formed on said barrel internal threads.

14. The flashlight of claim 10 wherein said sealant means comprises an 0-ring positioned on said neck.

15. The flashlight of claim 13 wherein said sealant means comprises an 0-ring positioned on said neck.

16. The flashlight of claim 10 wherein said case further comprises a plurality of ridges longitudinally formed on an outer surface of said casing.

17. The flashlight of claim 12 wherein said case further comprises a plurality of ridges longitudinally formed on an outer surface of said casing.

* * * * *